US009028267B2

(12) United States Patent
Furuya et al.

(10) Patent No.: US 9,028,267 B2
(45) Date of Patent: May 12, 2015

(54) POWER SHUTOFF DEVICE

(71) Applicant: Yazaki Corporation, Minato-ku, Tokyo (JP)

(72) Inventors: Yoshinobu Furuya, Kakegawa (JP); Ryuta Takishita, Kakegawa (JP); Go Yamada, Kakegawa (JP); Masaaki Iwabe, Kakegawa (JP); Toshiki Hirata, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/164,302

(22) Filed: Jan. 27, 2014

(65) Prior Publication Data

US 2014/0213087 A1 Jul. 31, 2014

(30) Foreign Application Priority Data

Jan. 28, 2013 (JP) ..... 2013-013190

(51) Int. Cl.

| | |
|---|---|
| ***H01R 13/62*** | (2006.01) |
| ***H01R 13/629*** | (2006.01) |
| ***H01R 9/16*** | (2006.01) |
| ***H01R 13/703*** | (2006.01) |

(52) U.S. Cl.

CPC ..... *H01R 13/62933* (2013.01); *H01R 9/16* (2013.01); *H01R 13/703* (2013.01)

(58) Field of Classification Search

CPC ..... H01R 13/703; H01R 13/7031; H01R 13/7032; H01R 13/62933; H01R 13/62938; H01R 13/62944; H01R 13/6295; H01R 13/62955; H01R 13/62961

See application file for complete search history.

(56) References Cited

U.S. PATENT DOCUMENTS

| | | | | |
|---|---|---|---|---|
| 8,915,749 | B2 * | 12/2014 | Ikeda et al. | 439/157 |
| 2006/0040535 | A1 * | 2/2006 | Koshy et al. | 439/157 |
| 2013/0126205 | A1 * | 5/2013 | Henmi | 174/53 |
| 2013/0224974 | A1 * | 8/2013 | Furuya et al. | 439/153 |
| 2013/0228429 | A1 * | 9/2013 | Henmi | 200/335 |
| 2014/0213087 | A1 * | 7/2014 | Furuya et al. | 439/271 |

FOREIGN PATENT DOCUMENTS

JP 2003-100383 A 4/2003

* cited by examiner

*Primary Examiner* — Ross Gushi

(74) *Attorney, Agent, or Firm* — Sughrue Mion, PLLC

(57) ABSTRACT

In a power shutoff device, an operation lever is provided to be rotatable between a first position where a receiving connector and the plug connector are separated and a second position where the receiving connector and the plug connector are fitted. The operation lever is slidable in a direction perpendicular to the fitting direction at the second position. A fitting detecting connector includes a fitting detecting receiving connector accommodating a pair of fitting detecting terminals in a pipe body penetrating and protruding from a side wall of a housing of the receiving connector, and a fitting detecting plug connector accommodating a conductive member electrically connecting the fitting detecting terminals in a pipe body. The fitting detecting plug connector is provided at a distal end part of the operation lever so as to be fitted to the fitting detecting receiving connector when the operation lever slides at the second position.

2 Claims, 11 Drawing Sheets

POWER SHUTOFF DEVICE

BACKGROUND

The present invention relates to a power shutoff device, particularly, to a connector-type power shutoff device which is installed between a power source and a load.

Generally, if a power source circuit which supplies power to a load includes a connector, by separating the connector, the load may be separated from the power source so that the load may be checked or maintained safely. However, when the power is cut off by detaching the connector, due to the load, an arc is produced between connector terminals of a plug connector and a receiving connector which are separated, thereby damaging the connector terminals or the like. Thus, in the operation of separating the fitted connector, two steps are performed in which a time lag is included. That is, a power shutoff device is proposed for which an action to make the connector shifted from a fitted state to a detached state is detected, a relay contact which is installed in the power source circuit is opened by the detection signal to cut off the power, and then the connector becomes detachable (for example, a patent document 1).

In the power shutoff device disclosed in the above patent document, an operation lever is rotatably and pivotally supported by the plug connector of the connector which is installed in the power source circuit, the operation lever is connected to the receiving connector, and the operation lever is rotated between a first position where the receiving connector and the plug connector are separated and a second position where the receiving connector and the plug connector are fitted. To detect the operation of separating the connector, the operation lever is formed to be slidable at the second position of the operation lever where the connector is fitted in a direction which is different from the direction that the operation lever is fitted, and a fitting detecting connector, which is formed of a fitting detecting plug connector and a fitting detecting receiving connector which are fitted to each other at a third position to which the operation lever slides, is provided on the operation lever and the receiving connector.

Therefore, when the fitting detecting connector is fitted, a fitting detecting signal becomes ON, a relay of a control circuit of the power source circuit is ON, and power is supplied to the load through the connector of the power source circuit. On the contrary, because when the operation lever slides from the third position to the second position to shift to the operation of separating the connector, the fitting detecting connector which was fitted is separated, the fitting detecting signal of the fitting detecting connector becomes OFF, the relay of the control circuit of the power source circuit is OFF, and the power supply to the load is cut off even if the connector of the power source circuit is fitted. Thereby, the arc which is produced when the connector of the power source circuit is separated can be surely prevented even if the connector is separated when the operation lever is rotated from the second position to the first position.

On the other hand, when the connector of the power source circuit is engaged, there is no problem like that the arc is produced when the connector is separated, but connector terminals of the power source circuit may be damaged because a rush current flows due to the load when the connecting terminals are connected. For this point, according to the power shutoff device of the above document 1, because the connector of the power source circuit is fitted without voltage at the second position of the operation lever where the fitting detecting connector is not fitted, that is, at a position where a relay contact of the power source circuit is opened, the connector terminals can be prevented from being damaged by the rush current of the load.

[Patent document 1] Japan Patent Publication No. 2003-100383

SUMMARY

According to one aspect of the present invention, there is provided a power shutoff device comprising:

a receiving connector configured to accommodate a pair of main terminals which is installed in a power source circuit;

a plug connector configured to be fitted into the receiving connector in a fitting direction and to accommodate a conductive member which electrically connects the pair of main terminals;

an operation lever configured to make the receiving connector and the plug connector fitted or separated; and a fitting detecting connector configured to detect a fitting state of the receiving connector and the plug connector, wherein the operation lever is rotatably and pivotally supported by the plug connector, has leg parts to be connected to the receiving connector, and is provided to be rotatable between a first position where the receiving connector and the plug connector are separated and a second position where the receiving connector and the plug connector are fitted, and to be slidable in a direction perpendicular to the fitting direction at the second position, the fitting detecting connector includes a fitting detecting receiving connector which accommodates a pair of fitting detecting terminals in a pipe body penetrating and protruding from a side wall of a housing of the receiving connector, and a fitting detecting plug connector which accommodates a conductive member electrically connecting the pair of fitting detecting terminals in a pipe body, and the fitting detecting plug connector is provided at a distal end part of the operation lever so as to be fitted to the fitting detecting receiving connector when the operation lever slides at the second position.

The power shutoff device may be configured such that: the housing of the receiving connector is fixed to an electrical junction box with fixing means through a flange which is formed on an outer peripheral surface of the housing of the receiving connector; an annular waterproof packing which is positioned closer to the housing than the fixing means at a surface of the flange facing the electrical junction box is clamped; a cover cylindrical part is formed on an outer circumferential edge of a housing of the plug connector to cover an upper end circumferential edge of the housing of the receiving connector; a waterproof packing is installed between the cover cylindrical part and the upper end circumferential edge of the housing of the receiving connector; and a waterproof packing is installed to the inner peripheral surface or the outer peripheral surface of the pipe body of one of the fitting detecting receiving connector and the fitting detecting plug connector.

BRIEF DESCRIPTION OF DRAWINGS

FIG. 11A is a front view which shows that the connector is at a first position (the connector is to be fitted), FIG. 11B is a sectional view which shows that the connector is at the first position (the connector is to be fitted), FIG. 11C is a sectional view which shows that the connector is at a second position (the connector has been fitted), and FIG. 11D is a sectional view which shows that the connector is at a third position (the connector is in use).

DETAILED DESCRIPTION OF EXEMPLIFIED EMBODIMENTS

The power shutoff device described in the patent document 1 may be further downsized. That is, since the fitting detecting receiving connector is provided along the outer side of the side surface in the longitudinal direction of the housing which accommodates the receiving connector, and the fitting detecting plug connector which is fitted to the fitting detecting receiving connector is provided at the side of the operation lever, the width in the lateral direction of the power shutoff device is increased. A waterproof structure is not considered in the power shutoff device described in the patent document 1.

It is therefore one advantageous aspect of the present invention to downsize the connector-type power shutoff device which is installed between a power source and a load.

Figure 1:
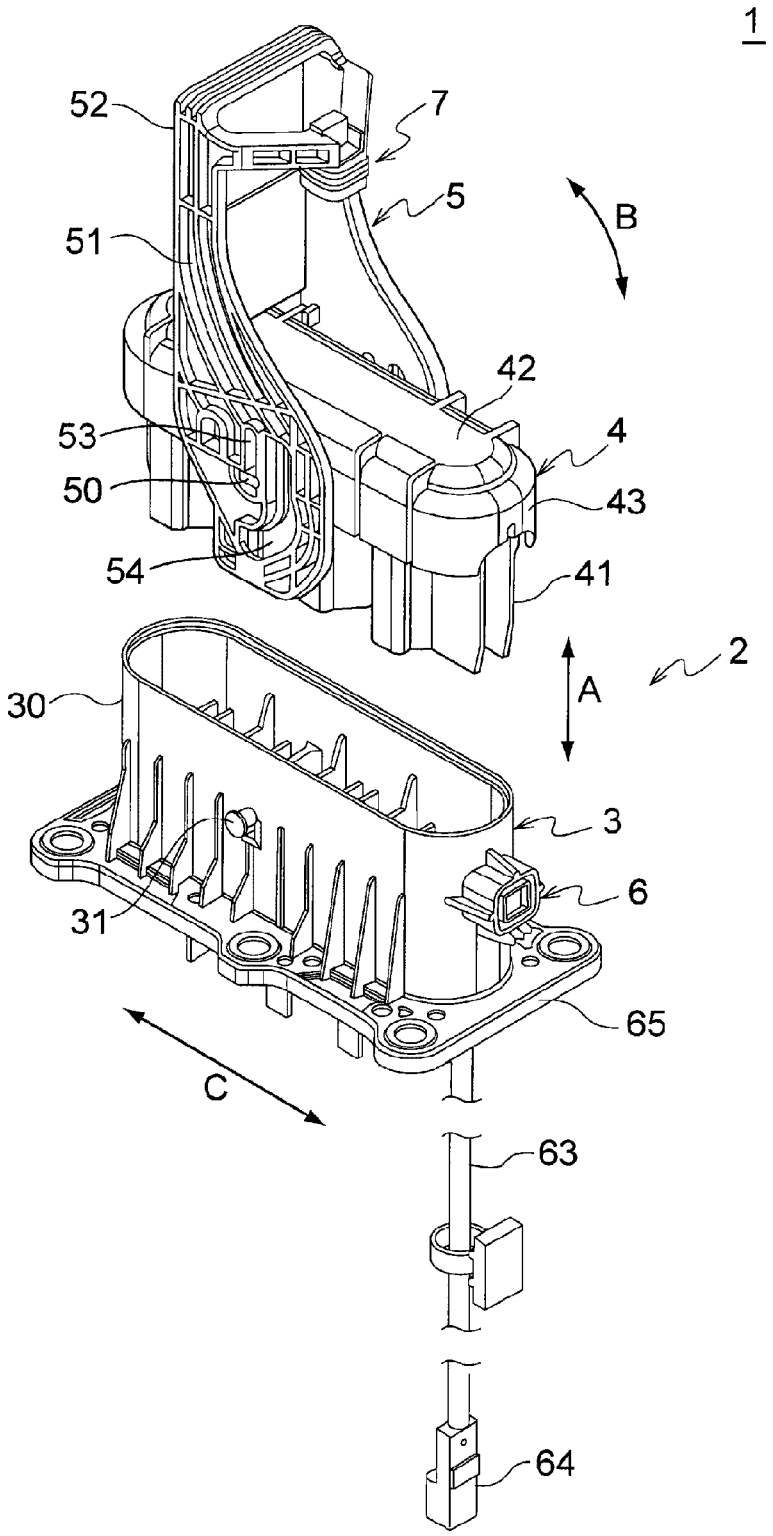
FIG. 1 is a perspective overall view of the connector-type power shutoff device of one embodiment of the present invention in which the connector is separated.

One embodiment of the connector-type power shutoff device of the present invention is described as follows with reference to FIGS. 1 to 11D. A power shutoff device 1 of the present embodiment, as shown in FIG. 1, mainly includes a connector 2 which is installed in a power source circuit. The connector 2 has a receiving connector 3 which accommodates a pair of main terminals and a plug connector 4 which is formed to be fittable to the receiving connector 3 and which accommodates a conductive member which electrically connects the pair of main terminals. The connector 2 includes an operation lever 5 which makes the receiving connector 3 and the plug connector 4 fitted or separated, and a fitting detecting connector 8 which includes a fitting detecting receiving connector 6 and a fitting detecting plug connector 7 to detect the fitting state of the receiving connector 3 and the plug connector 4. At a first position where the distal end part of the plug connector 4 is inserted into the receiving connector 3 by moving the plug connector 4 in an arrow A direction as shown in the figure, guiding grooves 53, which leg parts 51 of the operation lever 5 are provided with, are engaged with shafts 50, which are provided on the side surfaces of the plug connector 4, so that the operation lever 5 is rotatably and pivotally supported by the plug connector 4. The leg parts 51 of the operation lever 5 are provided with guiding grooves 54 which are engaged with shafts 31 which are formed to protrude from the side surfaces of the receiving connector 3. Thereby, when the operation lever 5 is rotated in an arrow B direction as shown in the figure, and the leg parts 51 of the operation lever 5 arrive at a horizontal position in the figure (a second position), the plug connector 4 is moved towards the side of the receiving connector 3 which is connected to the leg parts 51 of the operation lever 5 (in the arrow A direction as shown in the figure) and is fitted to the receiving connector 3.

Furthermore, the operation lever 5 is provided to be slidable in the longitudinal direction of the plug connector 4 which is a direction perpendicular to the fitting direction at the second position where the receiving connector 3 and the plug connector 4 are fitted. On the other hand, the fitting detecting connector 8 which detects the fitting state of the receiving connector 3 and the plug connector 4 includes the fitting detecting receiving connector 6 which is provided on a minor axis side surface of the receiving connector 3 and the fitting detecting plug connector 7 which is supported by the distal end part of the operation lever 5. When the operation lever 5 slides in an arrow C direction as shown in the figure at the second position, the fitting detecting plug connector 7 can be fitted/separated to/from the receiving connector 6.

Figure 2:
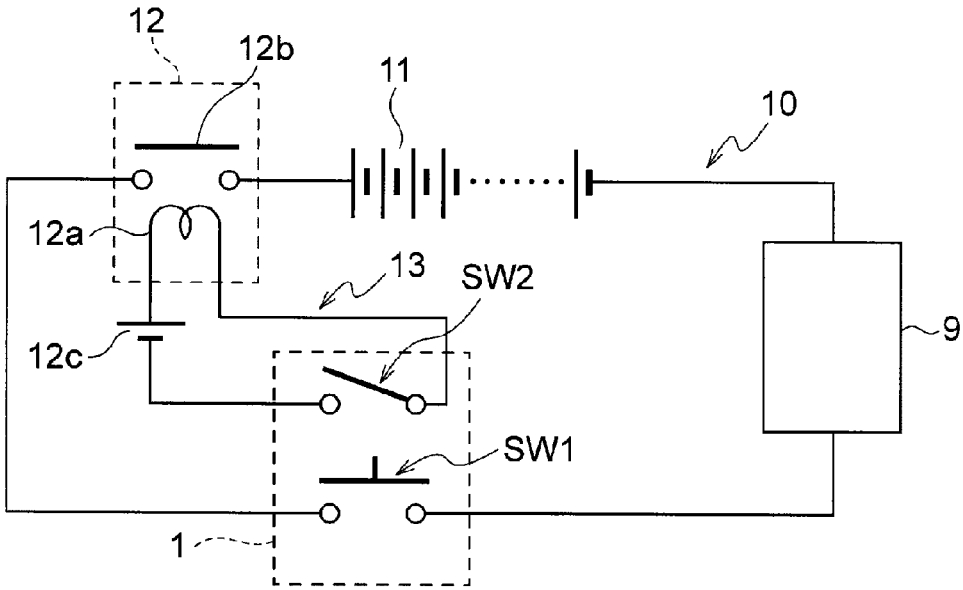
FIG. 2 is a power source circuit diagram of an example in which the connector-type power shutoff device of the present invention is applied.

The power shutoff device 1 of the present embodiment, for example, is used to be installed in a power source circuit 10 which supplies power to a load 9 as shown in FIG. 2. In the power source circuit 10, electric power is supplied from the power source 11 to the load 9 through a relay 12 and a switch SW1. The relay 12 includes a relay contact 12*b* which is opened or closed by an electromagnetic coil 12*a*, which is driven by a mechanical switch SW2 which is installed in an excitation circuit 13 which has a control power source 12*c*. The switch SW1 is formed with a pair of main terminals which are installed in the power source circuit 10 and a movable contact which is a conductive member to electrically connect the main terminals. The switch SW2 is formed with a pair of control terminals which are installed in the excitation circuit 13 of the relay 12 and a movable contact which is a conductive member to electrically connect the pair of control terminals. The power shutoff device 1 of the present embodiment can be used as the mechanical switches SW1, SW2. That is, the connector 2 can be used as the switch SW1 and the fitting detecting connector 8 can be used as the switch SW2. The power source circuit in FIG. 2 is just one example and the present invention is not limited to this.

Figure 3A:
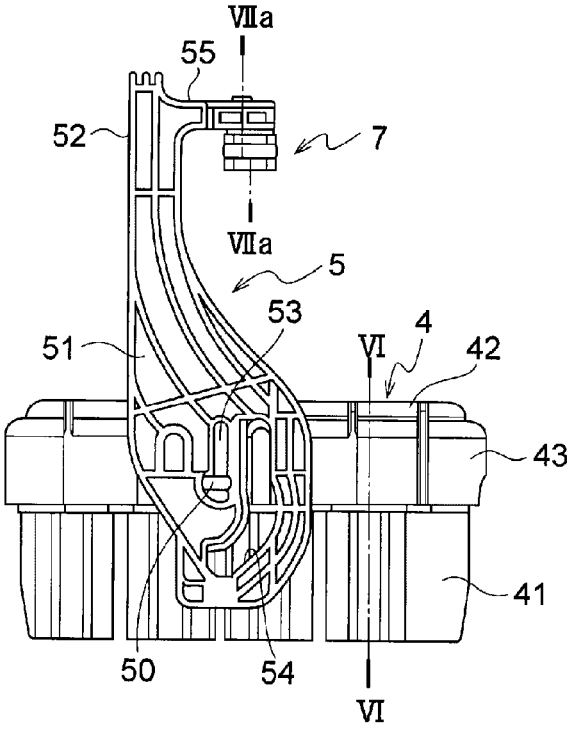
FIG. 3A is a detailed front view of a plug connector in FIG. 1.
Figure 3B:
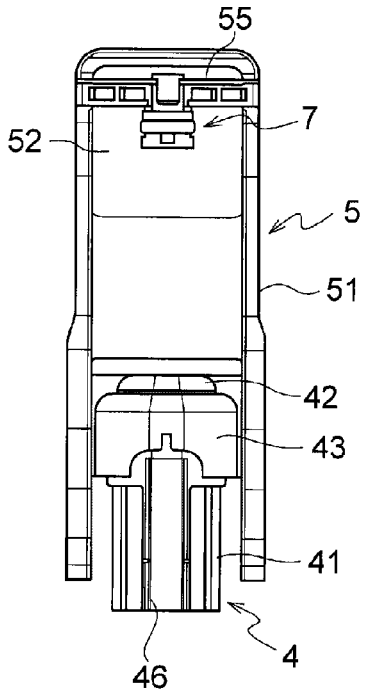
FIG. 3B is detailed side view of a plug connector in FIG. 1.
Figure 3C:
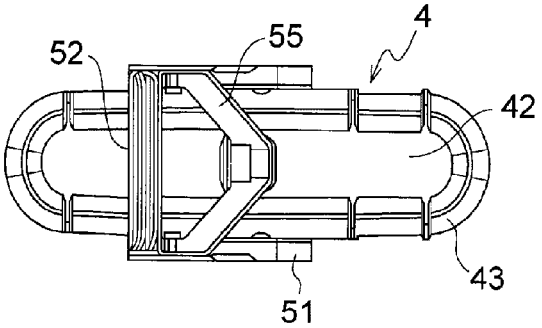
FIG. 3C is a detailed top view of a plug connector in FIG. 1.
Figure 4:
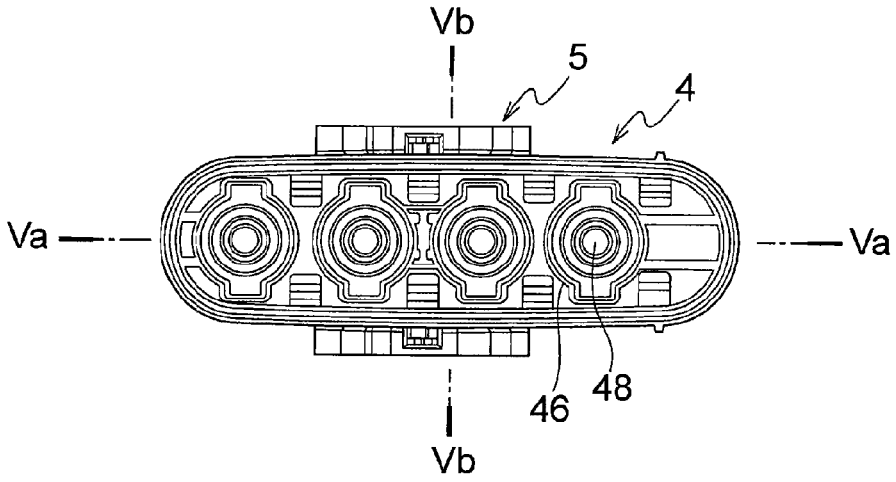
FIG. 4 is bottom view of the plug connector.
Figure 5A:
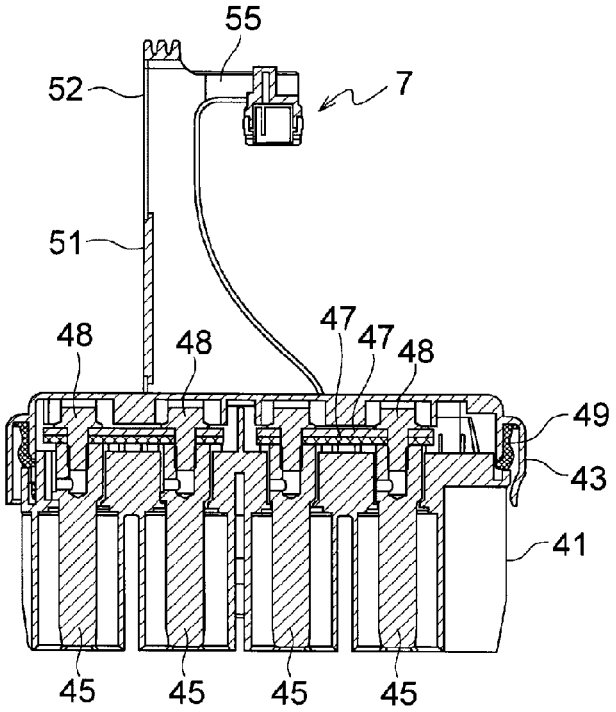
FIG. 5A is a Va-Va arrow sectional view of FIG. 4.
Figure 5B:
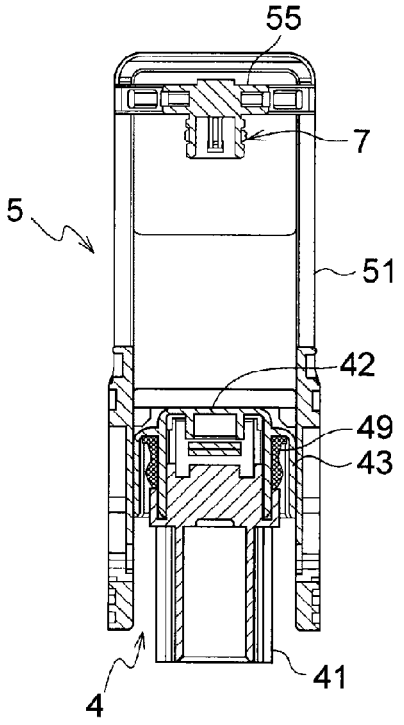
FIG. 5B is a Vb-Vb arrow sectional view of FIG. 4.
Figure 6:
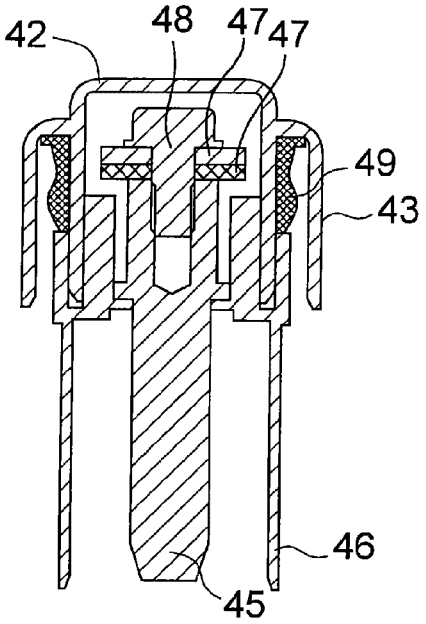
FIG. 6 is a VI-VI line sectional view of FIG. 3A.

Next, with reference to FIGS. 3A to 8C, the constructions of the plug connector 4, the operation lever 5 and the fitting detecting plug connector 7 are described. The plug connector 4, in FIGS. 3A to 3C, is formed with a resin housing 41 whose bottom surface is opened, and a lower part of the housing 41 is a fitting part to be inserted into the pipe-like receiving connector 3 to be described below. The upper end of the housing 41 is sealed by a cover 42 as shown in FIGS. 5A to 6. A cover cylindrical part 43 is formed to extend downward from the outer circumferential edges of the cover 42 along the upper end part of the housing 41, so that the cover cylindrical part 43 covers the upper end circumferential edges of the receiving connector 3. In the housing 41, two pairs of rod-like male terminals 45 are accommodated inside cylindrical partition walls 46, respectively, and are supported to be insulative from each other. Each of the male terminals 45, as shown in FIGS. 5A to 6, is so provided that the top part is positioned in a space inside the cover 42 above the partition walls 46. Two overlaid conductors 47 bridge the top parts of each pair of the male terminals 45 and are fixed to the top part of each of the male terminals 45 by bolts 48 so that each pair of the male terminals 45 are electrically connected to each other. A pipe-like waterproof packing 49 is installed around the cylindrical surface of the cover 42 which is opposed to the cover cylindrical part 43 at the upper end of the housing 41. In the present embodiment, it is exemplified that two pairs of male terminals 45 are included, but the present invention is not limited to this, and is applicable when the connector includes at least one pair of male terminals 45.

The operation lever 5 has a pair of flat leg parts 51 which sandwich the side surfaces in the longitudinal direction of the plug connector 4 and an operation part 52 which is formed to connect the upper end parts of the leg parts 51. The pair of leg parts 51 are formed with the guiding grooves 53 which extend in the longitudinal direction of the operation lever 5, and a pair of shafts 50 which are formed to protrude from the two side surfaces of the cover cylindrical part 43 at the upper part of the plug connector 4 are inserted into the guiding grooves 53. Thereby, the operation lever 5, as shown by the arrow B in FIG. 1, can be rotated around the shafts 50 and is pivotally supported by the plug connector 4. The pair of leg parts 51 are formed with the guiding grooves 54 which extend in the longitudinal direction of the operation lever 5. A pair of shafts 31 which are formed to protrude from the two side surfaces in the longitudinal direction of the receiving connector 3 to be described below are inserted into the guiding grooves 54. That is, the leg parts 51 of the operation lever 5 are connected to the receiving connector 3 by the guiding grooves 54. The shafts 50 are formed to have flat sections obtained by cutting opposed arc parts of a columnar. Accordingly, lower parts of the guiding grooves 53 in the figure have L-shaped steps, and are formed not to hinder the rotation of the operation lever 5. The groove width in the longitudinal direction of the guiding grooves 53 is set according to the thickness of the flat part of the shaft 50. Thereby, the operation lever 5 is stably supported by the plug connector 4 in the state in FIGS. 1 and 2 (the first position).

Figure 7A:
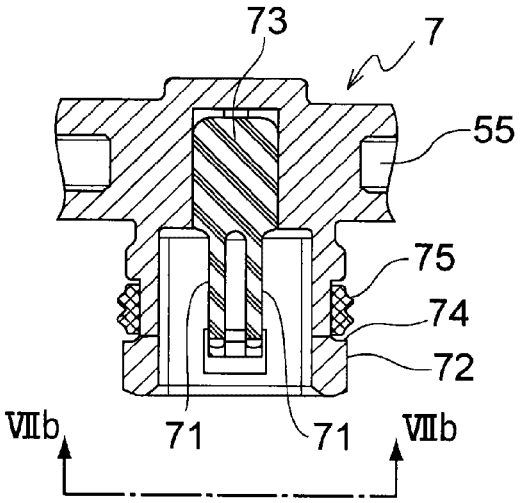
FIG. 7A is a VIIa-VIIa line sectional view of FIG. 3A.
Figure 7B:
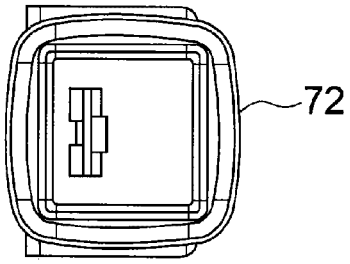
FIG. 7B is a VIIb-VIIb arrow view of FIG. 3A.
Figure 8A:
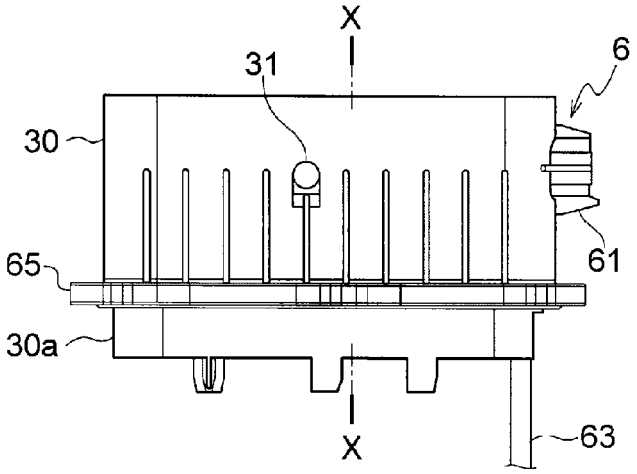
FIG. 8A is a detailed front view of a receiving connector in FIG. 1.
Figure 8B:
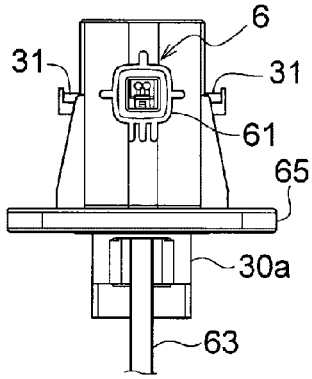
FIG. 8B is a detailed side view of a receiving connector in FIG. 1.
Figure 8C:
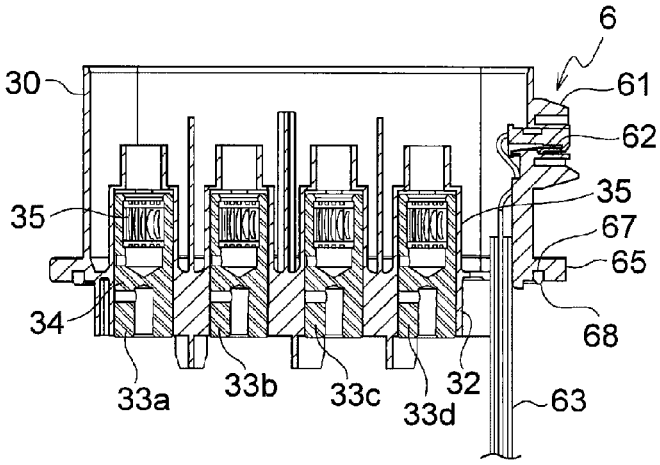
FIG. 8C is a detailed sectional view of a receiving connector in FIG. 1.
Figure 9:
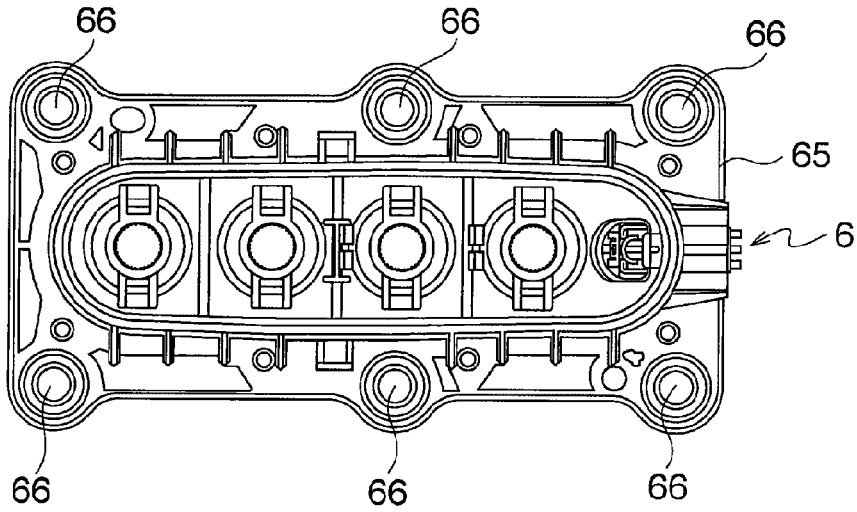
FIG. 9 is a bottom view of the receiving connector.
Figure 10:
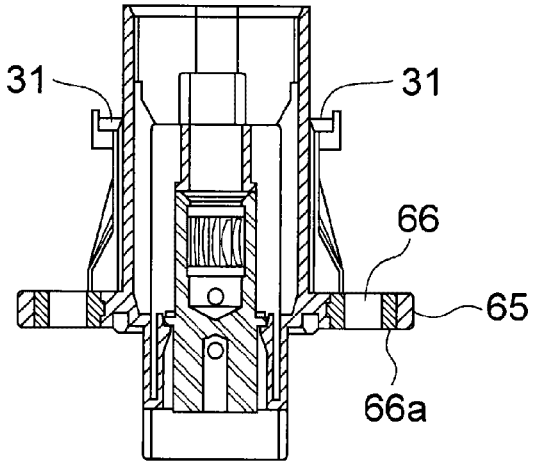
FIG. 10 is an X-X line sectional view of FIG. 8A.

Supporting arms 55 are provided to protrude to the back surface side of the operating part 52 of the operation lever 5, that is, the lower surface side when the operation lever 5 is rotated and the top surface of the operation lever 5 is at a position (the second position) to be generally parallel to the top surface of the plug connector 4. The fitting detecting plug connector 7 is attached to the supporting arms 55. The direction in which the fitting detecting plug connector 7 is attached, as shown in FIG. 1, is set to make the connector opening oppose to the connector opening of the fitting detecting receiving connector 6 at the second position as shown in FIG. 1. The fitting detecting plug connector 7 is so formed that, as shown in FIGS. 7A and 7B, a pair of male terminals 71, which are formed to be contactable to a pair of fitting detecting terminals to be described below which the fitting detecting receiving connector 6 is provided with, is accommodated in a pipe body 72 with a rectangular section. The pair of male terminals 71 is commonly connected to a conductor 73. That is, a conductive member which electrically connected the pair of fitting detecting terminals of the fitting detecting receiving connector 6 is formed of the pair of male terminals 71 and the conductor 73. The pipe body 72 is formed to be insertable into the pipe body of the plug connector 7 to be described below, and a pipe-like waterproof packing 75 is installed in a concave groove 74 which is formed on the outer peripheral surface of the pipe body 72.

With reference to FIGS. 8A to 10, the construction of the receiving connector 3 is described in detail herein. As shown in those figures, the receiving connector 3 includes a housing 30 which is formed into a pipe-like shape, and the trunk part of the housing has such a section that the short sides (short axis) of a rectangular become circular. The top surface of the housing 30 is opened so that the plug connector 4 can be inserted into the housing 30. Resin cylindrical partition walls 32 are formed in the bottom space of the housing 30, and a plurality of female terminals 33*a* to 33*d* which are the main terminals are provided in the partition walls 32. Each of the female terminals 33*a* to 33*d* is respectively formed into the same shape by accommodating a cylindrical female terminal 35 formed of a plurality of spring members in a conductive member 34 with a cylinder hollowed shape. A lead part of an electric wire (not shown in the figure) which is connected to the load 9 and the relay 12 is inserted into the lower end part of the conductive member 34 to be connected to the conductive member 34. To match with the electrical connection of the male terminals 45 of the plug connector 4, the female terminals 33*a* and 33*b* becomes a pair, and the female terminals 33*c* and 33*d* becomes another pair.

On the other hand, the fitting detecting receiving connector 6 is formed with a pipe body 61 which has a rectangular section and which penetrates and protrudes from a side wall on the short side (short axis) of the housing 30 of the receiving connector 3, and a pair of fitting detecting terminals 62 which are accommodated in the pipe body 61. The dimension of the inner surface of the pipe body 61 is formed according to the dimension of the outer surface of the pipe body 72 of the fitting detecting plug connector 7 which is the fitting counterpart of the pipe body 61. Lead lines of a signal wiring 63 which are insulatively coated are connected to the pair of fitting detecting terminals 62, respectively. The signal wiring 63 is drawn out from the bottom part of the housing 30, and is connected to a relay of the power source circuit which is provided inside the electrical junction box (not shown in the figure) via a signal line connector 64. Even if there are two pairs of female terminals 33 which are the main terminals, the fitting detecting connector 8 which is formed of the fitting detecting receiving connector 6 and the fitting detecting plug connector 7 only have to output one fitting detection signal. When, if necessary, the two pairs of female terminals 33 are interlocked with different relay contacts, two pairs of the fitting detecting terminals (two circuits) of the fitting detecting receiving connector 6 are provided, and accordingly, two pairs of conductive members of the fitting detecting plug connector 7 are provided.

The receiving connector 3 which is formed in this way is fixed to an electrical junction box (not shown in the figure) by fixing means such as bolts which are inserted into bolt holes 66 of a flange 65 which is formed to protrude from the outer peripheral surface of the lower part of the housing 30. Metal color rings 66*a* are fitted in the bolt holes 66. A waterproof packing 68 is installed in a groove 67 which is positioned at the housing 30 side of the bolt holes 66 and is formed to surround a lower part 30*a* of the housing 30 at the bottom surface of the flange 65.

Operation steps of the power shutoff device 1 of the present embodiment constructed in this way are described with reference to FIGS. 11A to 11D. In the above figure, A and B show that the operation lever 5 is at the first position. At the first position, the lower part of the plug connector 4 is inserted into the receiving connector 3, but the connector 2 is in a separated state. At this time, for the leg parts 51 of the operation lever 5, the lower ends of the guiding grooves 53 are positioned at the shafts 50 of the plug connector 4, and the lower ends of the guiding grooves 54 are engaged with the shafts 31 of the receiving connector.

Figure 11A:
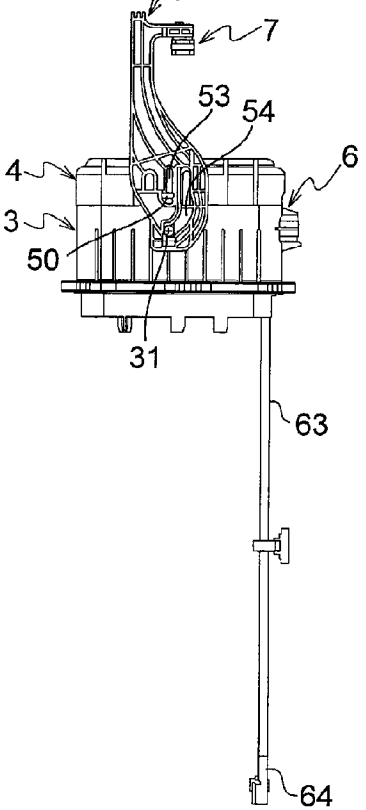
FIGS. 11A to 11D are figures which describe the operation of fitting the connector of the power shutoff device of the present embodiment in FIG. 1.
Figure 11B:
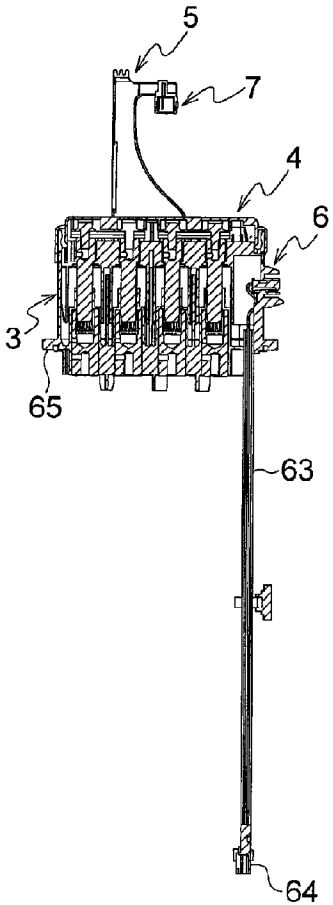
Figure 11C:
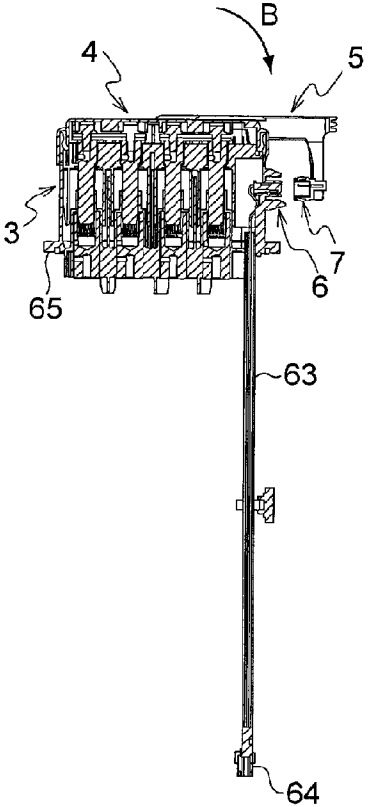

FIG. 11C shows that the operation lever 5 is rotated in the arrow B direction, and is operated to the second position where the top surface of the operation lever 5 is parallel to the top surface of the plug connector 4. By the rotation, the operation lever 5 is rotated around the shafts 50, and a force is applied to press down the plug connector 4 to the side of the shafts 31 which are engaged with the guiding grooves 54. Thereby, the male terminals 45 of the plug connector 4 are inserted into the female terminals 33 of the receiving connector 3, and the switch SW1 shown in FIG. 2 is closed.

Figure 11D:
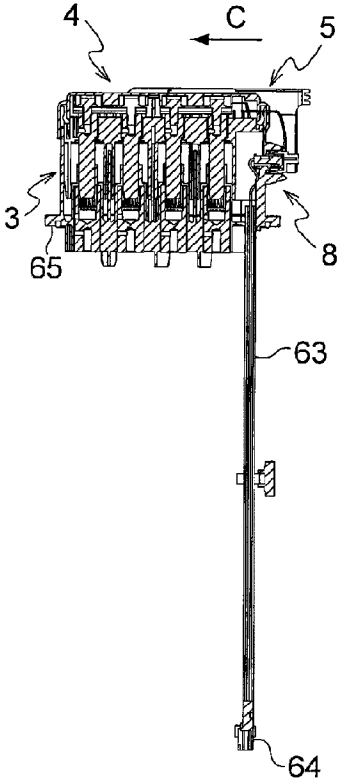

Next, as shown in FIG. 11D, the operation lever 5 slides in the arrow C direction. That is, the shafts 50 slide along the guiding grooves 53, and the shafts 31 slide along the guiding grooves 54. When the operation lever 5 arrives at the third position shown in the figure, the fitting detecting receiving connector 6 and the fitting detecting plug connector 7 of the fitting detecting connector 8 are fitted. Thereby, a pair of female terminals 62 of the fitting detecting receiving connector 6 are electrically connected by the pair of male terminals 71 of the fitting detecting plug connector 7 so that the switch SW2 shown in FIG. 2 is closed.

As described above, according to the present embodiment, since the fitting detecting plug connector 7 is provided at the distal end part of the operation lever 5, and the fitting detecting receiving connector 6 is provided in the pipe body 61 which penetrates and protrudes from a side wall on the short side (short axis) of the housing 30 of the receiving connector 3, the width in the lateral direction of the power shutoff device 1 is significantly reduced. That is, since the fitting detecting receiving connector 6 and the fitting detecting plug connector 7 are provided at the end part in the longitudinal direction of the receiving connector 3 and the operation lever 5, the width of the power shutoff device 1 is reduced and the power shutoff device 1 can be downsized.

According to the present embodiment, when the housing 30 of the receiving connector 3 is directly attached to the electrical junction box which accommodates the waterproof power source circuit and the control circuit which has the relay contact, the housing 30 of the receiving connector 3 is fixed to the electrical junction box with fixing means such as bolts through the flange 65 which is formed on the outer peripheral surface of the lower part of the housing 30 of the receiving connector 3, and the waterproof packing 68 which is positioned closer to the lower part 30*a* of the housing 30 than the fixing means at the surface of the flange 65 that faces the electrical junction box is clamped. Therefore, the plurality of female terminals which are provided inside the receiving connector 3, the electric wire drawn out part which is drawn out from the electrical junction box side and which is connected to the female terminals, and the signal wiring 63 drawn out part which is drawn out from the electrical junction box side and which is connected to the pair of female terminals 62 which are the fitting detecting terminals of the fitting detecting connector 8 can be collectively waterproofed.

Furthermore, the cover cylindrical part 43 is formed on the outer circumferential edge of the upper part of the housing 41 of the plug connector 4 to cover the upper end circumferential edge of the housing 30 of the receiving connector 3, and the waterproof packing 43 is installed between the cover cylindrical part 43 and the upper end circumferential edge of the housing 30 of the receiving connector 3. Therefore, the housings of the receiving connector 3 and the plug connector 4 of the connector 2 can be formed into a waterproof structure.

Furthermore, the waterproof packing 75 is installed to the inner peripheral surface or the outer peripheral surface of the pipe body of one of the fitting detecting receiving connector 6 and the fitting detecting plug connector 7 to waterproof the space between the pipe bodies. Accordingly, water can be prevented from invading into the pipe body of the fitting detecting connector 8. Thus, according to the present embodiment, the power shutoff device 1 can be waterproofed by a simple waterproof structure without being upsized.

Thus, according to the present invention, since the fitting detecting plug connector is provided at the distal end part of the operation lever, and the fitting detecting receiving connector is provided in a pipe body which penetrates and protrudes from a side wall in the lateral direction of the receiving connector housing, the width in the lateral direction of the power shutoff device is nearly the same as the width in the same direction of the receiving connector and the plug connector, and the power shutoff device can be downsized.

According to the power shutoff device of the present invention, a waterproof function can be included by a simple waterproof structure, which is particularly described as follows. It is preferred that when the housing of the receiving connector is directly attached to an electrical junction box which accommodates the waterproof power source circuit and the control circuit which has the relay contact, the housing of the receiving connector is fixed to the electrical junction box with fixing means such as bolts through a flange which is formed on the outer peripheral surface of the housing of the receiving connector, and an annular waterproof packing which is positioned closer to the housing than the fixing means at the surface of the flange that faces the electrical junction box is clamped. Thereby, the plurality of main terminals which are provided inside the receiving connector, the electric wire drawn out part which is drawn out from the electrical junction box side and which is connected to the main terminals, and the drawn out part of fitting detecting signal wiring which is drawn out from the electrical junction box side and which is connected to the fitting detecting terminals of the fitting detecting connector can be collectively formed as s waterproof structure.

Furthermore, it is preferred that a cover cylindrical part is formed on the outer circumferential edge of the housing of the plug connector to cover the upper end circumferential edge of the housing of the receiving connector, and a waterproof packing is installed between the cover cylindrical part and the upper end circumferential edge of the housing of the receiving connector. Thereby, the housings of the receiving connector and the plug connector of the connector can be formed into a waterproof structure.

Furthermore, it is preferred that a waterproof packing is installed to the inner peripheral surface or the outer peripheral surface of the pipe body of one of the fitting detecting receiving connector and the fitting detecting plug connector to waterproof the space between the pipe bodies. Accordingly, the fitting detecting connector itself can be waterproofed. Thus, only by using the simple waterproof structures, the power shutoff device can be waterproofed without being upsized.

According to the present invention, the connector-type power shutoff device which is installed between a power source and a load can be downsized.

What is claimed is:

1. A power shutoff device comprising:

a receiving connector configured to accommodate a pair of main terminals which is installed in a power source circuit;

a plug connector configured to be fitted into the receiving connector in a fitting direction and to accommodate a conductive member which electrically connects the pair of main terminals;

an operation lever configured to make the receiving connector and the plug connector fitted or separated; and a fitting detecting connector configured to detect a fitting state of the receiving connector and the plug connector, wherein the operation lever is rotatably and pivotally supported by the plug connector, has leg parts to be connected to the receiving connector, and is provided to be rotatable between a first position where the receiving connector and the plug connector are separated and a second position where the receiving connector and the plug connector are fitted, and to be slidable in a direction perpendicular to the fitting direction at the second position, the fitting detecting connector includes a fitting detecting receiving connector which accommodates a pair of fitting detecting terminals in a pipe body penetrating and protruding from a side wall of a housing of the receiving connector, and a fitting detecting plug connector which accommodates a conductive member electrically connecting the pair of fitting detecting terminals in a pipe body, and the fitting detecting plug connector is provided at a distal end part of the operation lever so as to be fitted to the fitting detecting receiving connector when the operation lever slides at the second position.

2. The power shutoff device according to claim 1, wherein the housing of the receiving connector is fixed to an electrical junction box with fixing means through a flange which is formed on an outer peripheral surface of the housing of the receiving connector, an annular waterproof packing which is positioned closer to the housing than the fixing means at a surface of the flange facing the electrical junction box is clamped, a cover cylindrical part is formed on an outer circumferential edge of a housing of the plug connector to cover an upper end circumferential edge of the housing of the receiving connector, a waterproof packing is installed between the cover cylindrical part and the upper end circumferential edge of the housing of the receiving connector, and a waterproof packing is installed to the inner peripheral surface or the outer peripheral surface of the pipe body of one of the fitting detecting receiving connector and the fitting detecting plug connector.

* * * * *